US009564043B2

(12) United States Patent
Sanders et al.

(10) Patent No.: US 9,564,043 B2
(45) Date of Patent: Feb. 7, 2017

(54) AUTOMATED FIREARM SECURITY MEASURES TO CONTACT ASSISTANCE

(71) Applicant: Double Pull Inc., South Lake, TX (US)

(72) Inventors: Raymon Sanders, Irving, TX (US); David Lee Sanders, Irving, TX (US); Kenneth Conquest, Streemwood, IL (US); Michael R. Saylor, Plano, TX (US); Evan H. R. Spreen, South Lake, TX (US); David R. Spreen, South Lake, TX (US)

(73) Assignee: Double Pull Inc, Southlake, TX (US)

( * ) Notice: Subject to any disclaimer, the term of this patent is extended or adjusted under 35 U.S.C. 154(b) by 0 days.

(21) Appl. No.: 14/639,737

(22) Filed: Mar. 5, 2015

(65) Prior Publication Data

US 2015/0254968 A1 Sep. 10, 2015

Related U.S. Application Data

(60) Provisional application No. 61/948,358, filed on Mar. 5, 2014.

(51) Int. Cl.

| | |
|---|---|
| ***G08B 1/08*** | (2006.01) |
| ***G08B 25/01*** | (2006.01) |
| ***F41C 33/02*** | (2006.01) |
| *G08B 13/16* | (2006.01) |

(52) U.S. Cl.

CPC ..... *G08B 25/016* (2013.01); *F41C 33/029* (2013.01); *F41C 33/0227* (2013.01); *G08B 13/1672* (2013.01)

(58) Field of Classification Search

None

See application file for complete search history.

(56) References Cited

U.S. PATENT DOCUMENTS

| | | | | | |
|---|---|---|---|---|---|
| 4,936,037 | A * | 6/1990 | Holcomb | F41A 9/65 | 340/539.1 |
| 5,108,019 | A * | 4/1992 | Woodward | F41C 33/0227 | 224/243 |
| 5,479,149 | A * | 12/1995 | Pike | F41C 33/0209 | 340/539.1 |
| 5,525,966 | A * | 6/1996 | Parish | F41C 33/0227 | 224/243 |
| 5,715,623 | A * | 2/1998 | Mackey, III | F41A 17/06 | 42/1.01 |
| 5,828,301 | A * | 10/1998 | Sanchez | F41C 33/029 | 224/244 |
| 6,408,555 | B1 * | 6/2002 | Sapia | F41A 17/06 | 42/70.07 |
| 6,641,009 | B2 * | 11/2003 | French | F41C 33/0209 | 224/193 |
| 7,703,229 | B2 * | 4/2010 | Parhofer | F41A 17/063 | 42/70.01 |

(Continued)

*Primary Examiner* — Travis Hunnings

(57) ABSTRACT

Removing a gun or other weapon from a holster may inevitably require police backup to secure officer safety. One example device may include a weapon securing holster and a wireless presence detection antenna which receives wireless proximity data from a weapon drawn from the holster. Other features may include a sensor which detects a presence of the weapon and a processor which processes sensor data generated by the at least one sensor and radio frequency signals identifying a proximity of the weapon to the wireless presence detection antenna.

18 Claims, 5 Drawing Sheets

(56) References Cited

U.S. PATENT DOCUMENTS

| | | | | |
|---|---|---|---|---|
| 7,714,720 | B2 * | 5/2010 | Hietanen | F41A 17/063 224/243 |
| 7,735,253 | B2 * | 6/2010 | Giebel | A47B 81/00 42/70.11 |
| 7,944,676 | B2 * | 5/2011 | Smith | F41A 17/063 361/232 |
| 8,205,372 | B2 * | 6/2012 | Anzeloni | F41A 17/063 42/70.01 |
| 9,140,509 | B2 * | 9/2015 | Sullivan | F41A 35/00 |
| 2006/0208857 | A1 * | 9/2006 | Wong | F41C 33/0209 340/5.82 |

* cited by examiner

100

150

300

400

AUTOMATED FIREARM SECURITY MEASURES TO CONTACT ASSISTANCE

CROSS-REFERENCE TO RELATED APPLICATIONS

This application claims the benefit of and is a non-provisional of U.S. provisional application Ser. No. 61/948,358, filed on Mar. 5, 2014, herein incorporated by reference.

TECHNICAL FIELD OF THE APPLICATION

This application relates to personal safety and more specifically to the safety of police officers carrying a firearm. Whenever an officer has to draw his or her firearm he or she is by definition threatened and in need of backup which can be called upon automatically via a device configuration integrated within the firearm/holster and related portions of that configuration.

BACKGROUND OF THE APPLICATION

Conventionally, peace or "police" officers are exposed to violent threats more than any other segment of the domestic population. Many times the situations escalate to a "use of force" before an officer has time to call for backup (i.e., another squad car, another officer, etc.). Sometimes the act of manually picking up a radio or other communication device and calling for backup escalates a situation. Also, the process requires at least one hand and an estimated number of seconds to perform such an act. An automated system that can silently report the location of an officer and inform dispatch (backup) when he or she performs such dangerous activities, including but not limited to releasing the retention on the pepper spray, baton, and/or firearm holster, draws his or her weapon, fires his or her weapon, or falls to the ground in the line of duty, etc., could save an officer's life. Furthermore, such a configuration should call for backup if the weapon leaves the officer's immediate surroundings, and the officer should also be able to use verbal prompts, gestures, etc. to trigger for backup as well.

SUMMARY OF THE APPLICATION

One embodiment of the present application may include an apparatus that includes at least one of weapon securing holster, a wireless presence detection antenna which receives wireless proximity data from a weapon, and at least one sensor which detects a presence of the weapon.

Another embodiment of the present application may include at least one of receiving via a wireless presence detection antenna wireless proximity data from a weapon in wireless communication with a weapon holster comprising the wireless presence detection antenna, detecting a sensor condition triggered via at least one sensor affixed to the weapon holster, and creating a message to request assistance responsive to at least one of the wireless proximity data being received and the sensor condition being triggered.

DETAILED DESCRIPTION OF THE APPLICATION

It will be readily understood that the components of the present application, as generally described and illustrated in the figures herein, may be arranged and designed in a wide variety of different configurations. Thus, the following detailed description of the embodiments of an apparatus, and system configuration, as represented in the attached figures, is not intended to limit the scope of the application as claimed, but is merely representative of selected embodiments of the application.

The features, structures, or characteristics of the application described throughout this specification may be combined in any suitable manner in one or more embodiments. For example, the usage of the phrases "example embodiments", "some embodiments", or other similar language, throughout this specification refers to the fact that a particular feature, structure, or characteristic described in connection with the embodiment may be included in at least one embodiment of the present application. Thus, appearances of the phrases "example embodiments", "in some embodiments", "in other embodiments", or other similar language, throughout this specification do not necessarily all refer to the same group of embodiments, and the described features, structures, or characteristics may be combined in any suitable manner in one or more embodiments.

Figure 1A:
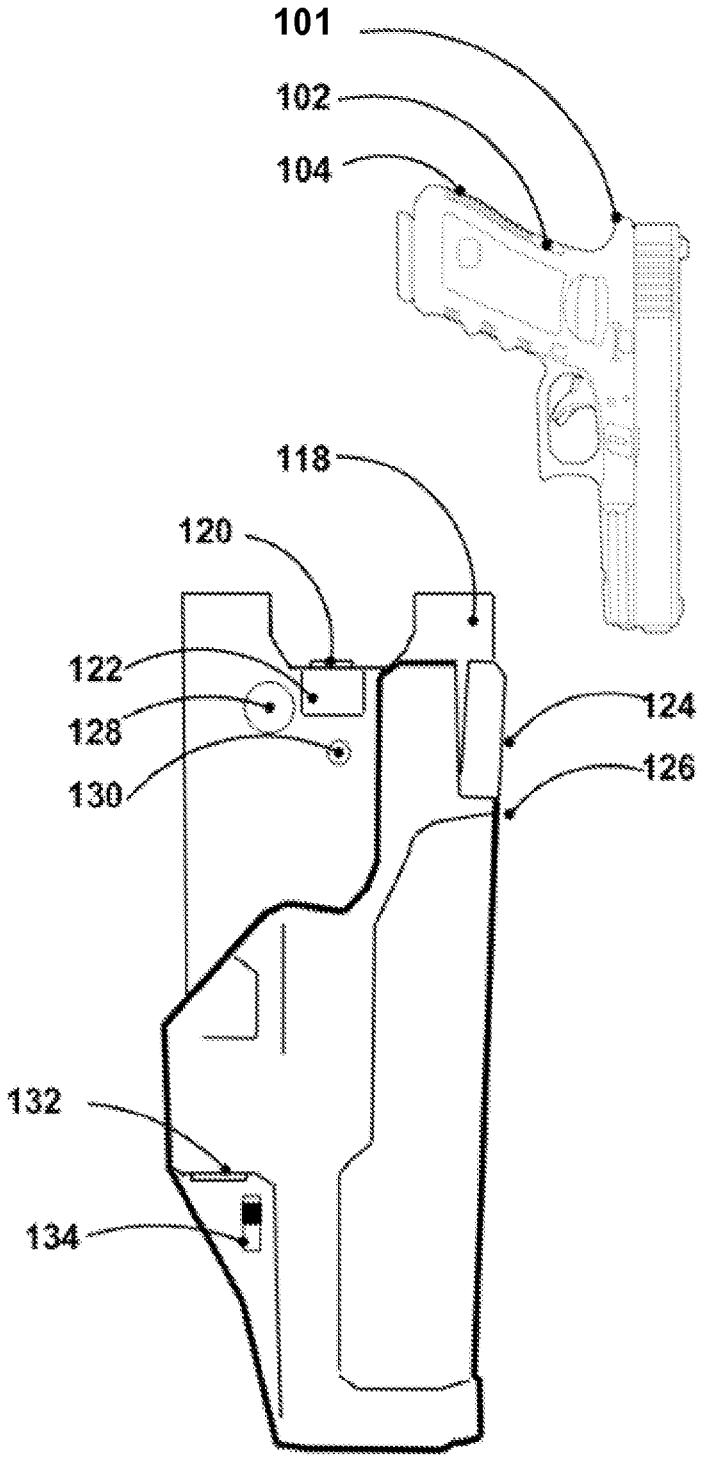
FIG. 1A illustrates an example firearm and holster configuration according to example embodiments.

FIG. 1A illustrates an example set of components together which form the backup notification system according to example embodiments. Referring to FIG. 1A, the system 100 includes a firearm 101 with a passive radio frequency (RF) identifier (ID) tag affixed to the firearm and configured to identify the firearm and determine its physical proximity to the holster 118 which includes an active RF ID tag. A passive RF ID tag may be an antenna with no transmission capability and/or no battery used to transmit RF signals. The active RF ID tag may include an active power source (not shown) which provides power to transmit a beacon to locate the passive RF ID tag. The active RF ID tag 104 may also be placed on the firearm to be used as a beacon to locate a lost or stolen hand gun in the event that the gun is removed from its holster and moved an appreciable distance away (e.g., 10 feet or more). The active tag 104 may beacon to the holster 118 and when the beacon is lost the holster may trigger an alert to the communication system. In addition to RFID technology being integrated into the weapon and holster configurations of FIGS. 1A and 1B, the antenna and tags may instead be near field communication tags (NFC).

The holster configuration main body 118 may be constructed of any suitable material (i.e., leather, plastic, Neoprene®, etc.) and adapted to fit any particular make or model of suitable hand gun. The RF antenna 120 may be used for transmitting and receiving communication signals on any suitable frequency including but not limited to Bluetooth unregulated RF, GPS, etc. Microcontroller logic module 122 processes the signals, and may contain a microcontroller power supply, memory and other necessary components to receive, store and process signals, the processor may also contains a small accelerometer to detect firearm movement and changes in position which may trigger communication signals be transmitted as well. An active retention mechanism 124 may be monitored by a retention switch 126 which detects when the retention mechanism 124 has been opened. Proximity detection sensor 128 may be used to detect when the gun is removed from the proximity of the holster 118. The proximity sensor 128 may be an active and/or passive tag used to pair with the active and passive tags on the gun 101. The passive tag 102 on the gun 101 may indicate to an active tag as part of the proximity sensor 128 on the holster that the gun has been removed from the holster. The active tag 104 on the gun may indicate that the gun is out of proximity to a passive tag as part of the proximity sensor 128 as well. An acoustic sensor 130 may be used for detection of shots fired and may also be a trigger of calling for backup via the microcontroller 120 in communication with a calling device (e.g., cell phone, radio, etc.). A handgun detection switch 132 may be used to determine when the handgun is removed from the holster such as a simple movement sensor. Also, a system activation switch 134 may permit deactivation for training or maintenance purposes.

The accelerometer can detect fast movement, such as running, fighting, falling, gun fire, explosions, automobile accidents/chases, etc., and report such information to the processor accordingly. The processor can then generate messages to inform the call center backup is needed or at least to attempt to contact the officer in question for confirmation or lack thereof prior to dispatching backup. The components on the gun itself including active and passive tags 102/104 and all the portions of FIG. 4 may be concealed, embedded and otherwise hidden from view on the weapon.

Figure 1B:
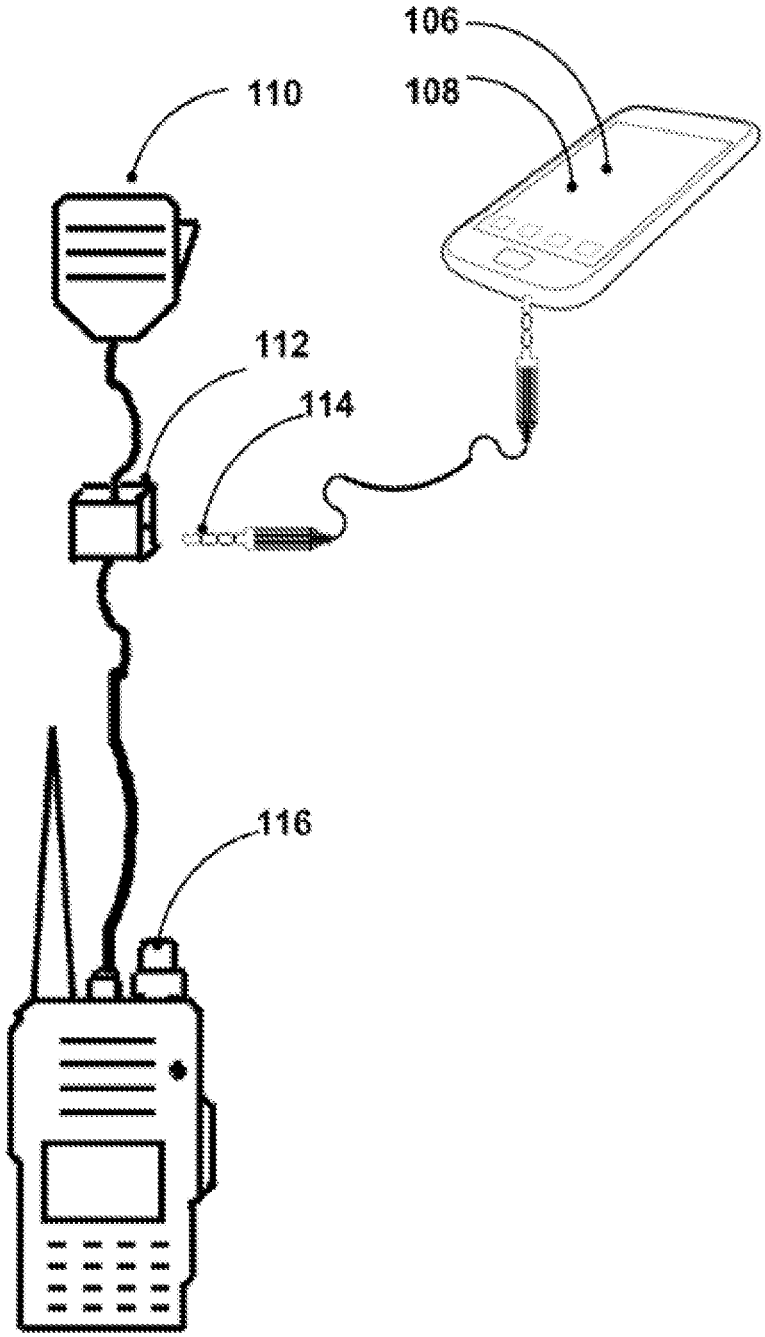
FIG. 1B illustrates an example communication configuration corresponding to the firearm and holster according to example embodiments.

FIG. 1B illustrates a trigger communication system in accordance with the firearm configuration of FIG. 1A. Referring to FIG. 1B, the system 150 includes a phone or smartphone 106 configured to provide geo-location data via GPS communication, message generation (i.e., SMS messaging) and an alternative signal path (i.e., radio) for communicating with officer assistance. The phone 106 supports a specialized application 108 to facilitate summoning and enabling geo-location. The phone 106 may communicate with the holster of FIG. 1A via BLUETOOTH wireless communication or via a direct wired link including a standard police radio microphone 110 with cord. This configuration may be plugged into a specialized inline interface device module 112 which in turn can be plugged directly into a standard police radio 116 and microphone. It is also adapted to receive, input from the holster, or the smartphone or both using wired or wireless technology. A standard interface cable of serial cable 114 can be used for sending voice or data from the smartphone to a police radio 116 and its corresponding network.

According to example embodiments, detection, location and other identification and communication techniques may be used to locate the officer and send an alert "officer needs assistance" message automatically over the existing communication network any time the office has to draw his/her weapon. An addition message may be transmitted if the noise sensor detects a "shots fired" message assuming the weapon discharge has already been detected. Geo-tracking technology may further be used to geo-locate the firearm and to help recover lost or stolen weapons in the event of a struggle between the officer and the subject of pursuit. Additional options may include a video option that transmits video based on what the officer is witnessing. The video player may be mounted on the weapon, the holster and/or the officer's personal body space and may use a wireless communication interface to transmit the video data recorded.

The weapon and the holster may communicate by the weapon transmitting data to the holster that will in turn transmit messages to a transmitter inside the police car. The police car will then transmit the data to dispatch via radio or cellular communications. The weapon has a passive RFID tag 102 and an active RFID tag 104 each serving individual requirements. The passive tag 102 notifies the active tag 128 on the holster when the device is removed from the holster. This initiates two transmissions to dispatch, the first notifies dispatch that the officer has removed his or her gun from the holster, and the second notifies dispatch of the officer's current GPS coordinates. Dispatch can then decide to send backup officers or not depending on the follow-up communications. The active tag 104 beacons to the passive tag 128 on the holster when the weapon has moved 10 feet or more away from the holster (i.e., officer no longer has gun). The holster then transmits a weapon stolen message to dispatch. Dispatch should then dispatch additional officers to assist.

In another example scenario, the weapon houses all sensors and transmits text data to dispatch through a cellphone tower. The weapon monitors its proximity to the holster via the RFID tags on the weapon and the holster. The weapon may be removed from the holster and the active tag 102 is used to transmit a message to dispatch through the data communications text cell phone link. When the weapon is not in the holster it monitors the GPS coordinates of the holster and/or of itself. Should the GPS coordinates differ by more than 20, 30, 40, feet etc., the weapon will transmit a "stolen gun" text message to dispatch through the closest cell phone tower. It will continue to transmit GPS coordinates every 10 minutes until its batteries die. This permits the weapon to be tracked and recovered and will also help to track and catch the criminal(s).

In the event that the weapon is fired, the accelerometer inside the weapon will transmit an officer's gun fired message and whether it is a single shot or repetitive shots fired, and this message can be sent as a text message to dispatch through the closest cell phone tower. If however, the officer falls or is in an auto accident as evidenced by the accelerometer the weapon will transmit a message to dispatch through the closest cell phone tower and an indication either that the officer is down or the officer is in an auto accident. The accelerometer can differentiate sudden stops in both the horizontal and vertical direction and translates a fall as opposed to an auto accident.

Figure 2:
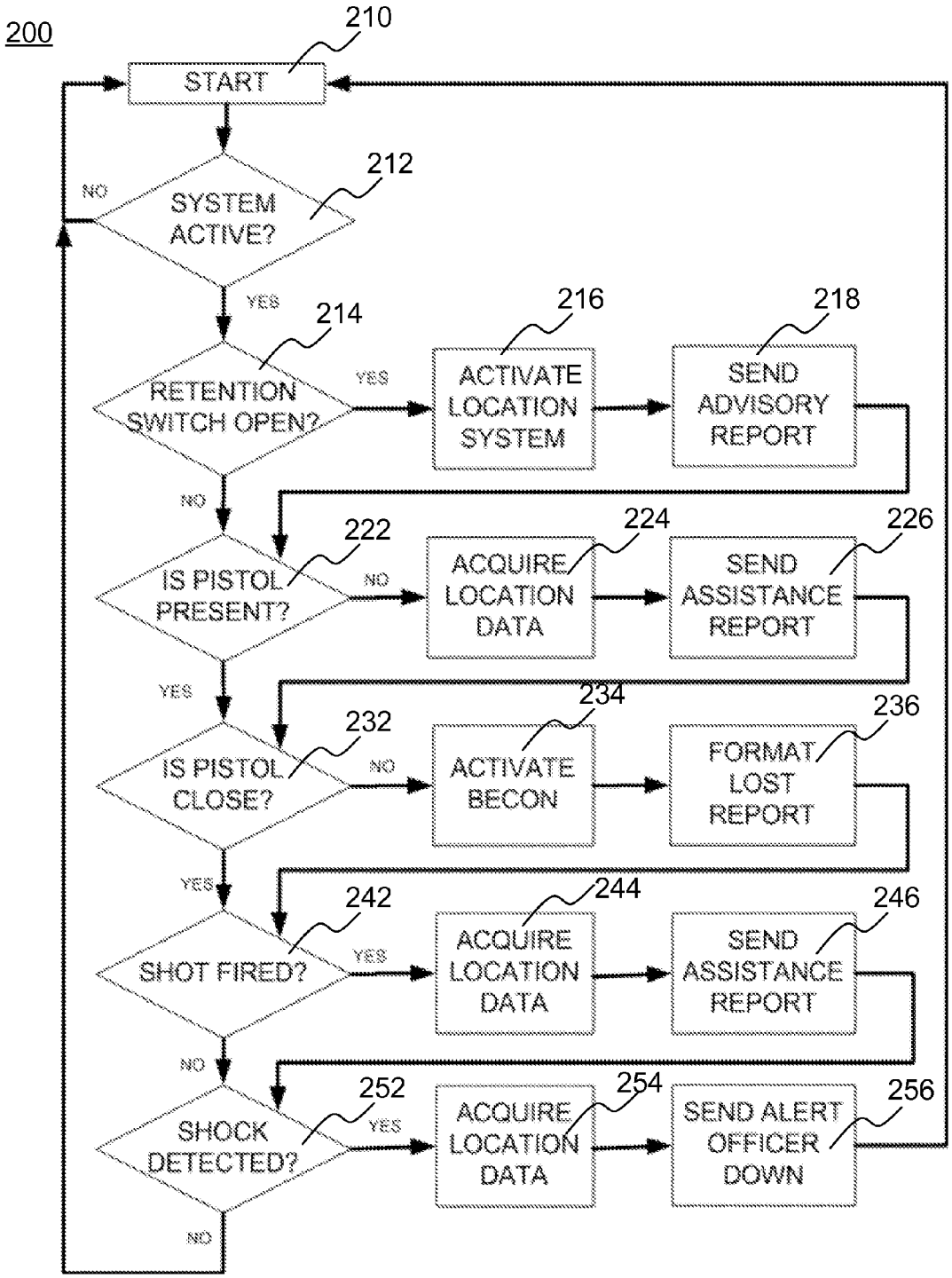
FIG. 2 illustrates an example flow diagram of the operation of the firearm security configuration according to example embodiments.

FIG. 2 illustrates a logic diagram according to example embodiments. Referring to FIG. 2, the software contained within the memory of the system that is executed by the microcontroller may provide a procedure 200 that includes start logic 210 which in initiates a determination whether the system is active 212. If so, a determination is performed whether the retention switch is open 214. If so, the location system 216 can be activated and the report is generated and sent 218 to a reporting device, however, a determination is performed whether the weapon is present 222. The location can be acquired 224 and a report can be generated 226. Next, a determination is performed whether the weapon is close 232, meaning it can be detected via the RFID reader on the holster. If not, the beacon is activated 234 and a lost weapon report is generated 236 and sent to the radio communication device to notify the authorities. Then, a determination is performed whether shots were fired 242 as may be detected by the audio sensor on the holster. If so, the location 244 is acquired and a report is sent 246. Then, a determination is performed whether a shock is detected 252 via the accelerometer, such as a change in position or a significant movement which could be associated with a fall, struggle, automobile accident, etc., the location can be acquired 254 and an emergency report can be transmitted to the proper recipients 256.

Figure 3:
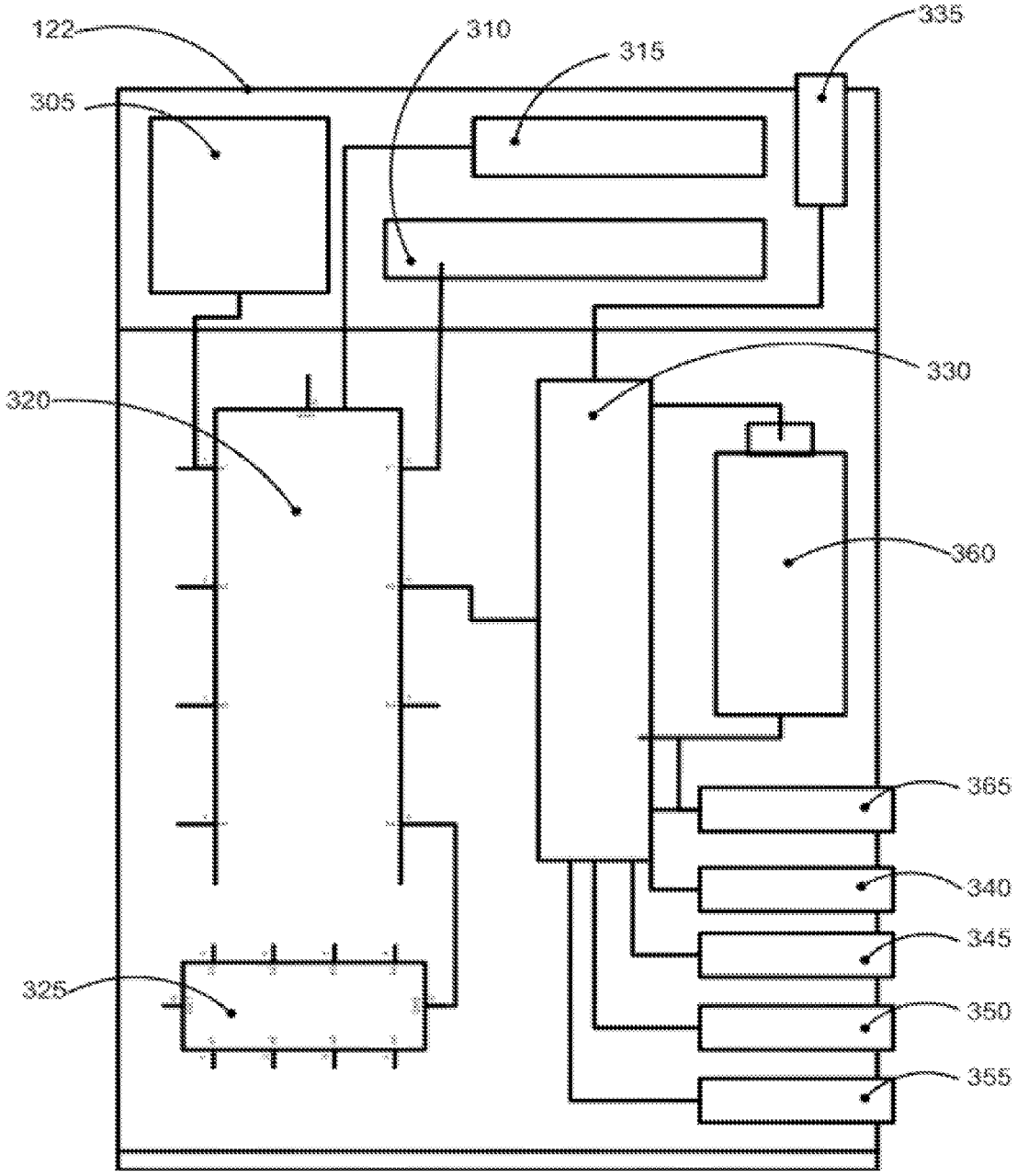
FIG. 3 illustrates the system hardware components of the holster according to example embodiments.

FIG. 3 illustrates a detailed layout of the processor and control functions of the unit 122 of holster device of FIG. 1A. Referring to FIG. 3, the electronics module housing 122 represents the portion of the holster 118, which contains the necessary components of the system. The module may include a global positioning system (GPS) receiver 305 for locating the device, a radio frequency antenna 310 for communicating via BLUETOOTH or another suitable frequency. A wireless proximity detection antenna 315 for transmitting and receiving signals, a microcontroller central processing unit 320, which can be any suitable controller that can manage the flow of information between communication of the GPS and other systems components. The CPU component is responsible for sending signals to external communications systems such as mobile phones and radio systems. A memory unit 325 is used to store systems instructions. An input/output unit 330 manages access from the CPU to external switches and devices. An external interface port 335 is used for a connection to a mobile phone. Other components may include an external connection to a retention switch 340, an external connection 345 to a weapon presence switch, an external connection to an acoustic detection device 350, and an external connection 355 to a power switch. A battery 360 may be either replaceable or rechargeable and an external power connector 365 may be used for battery charging.

Figure 4:
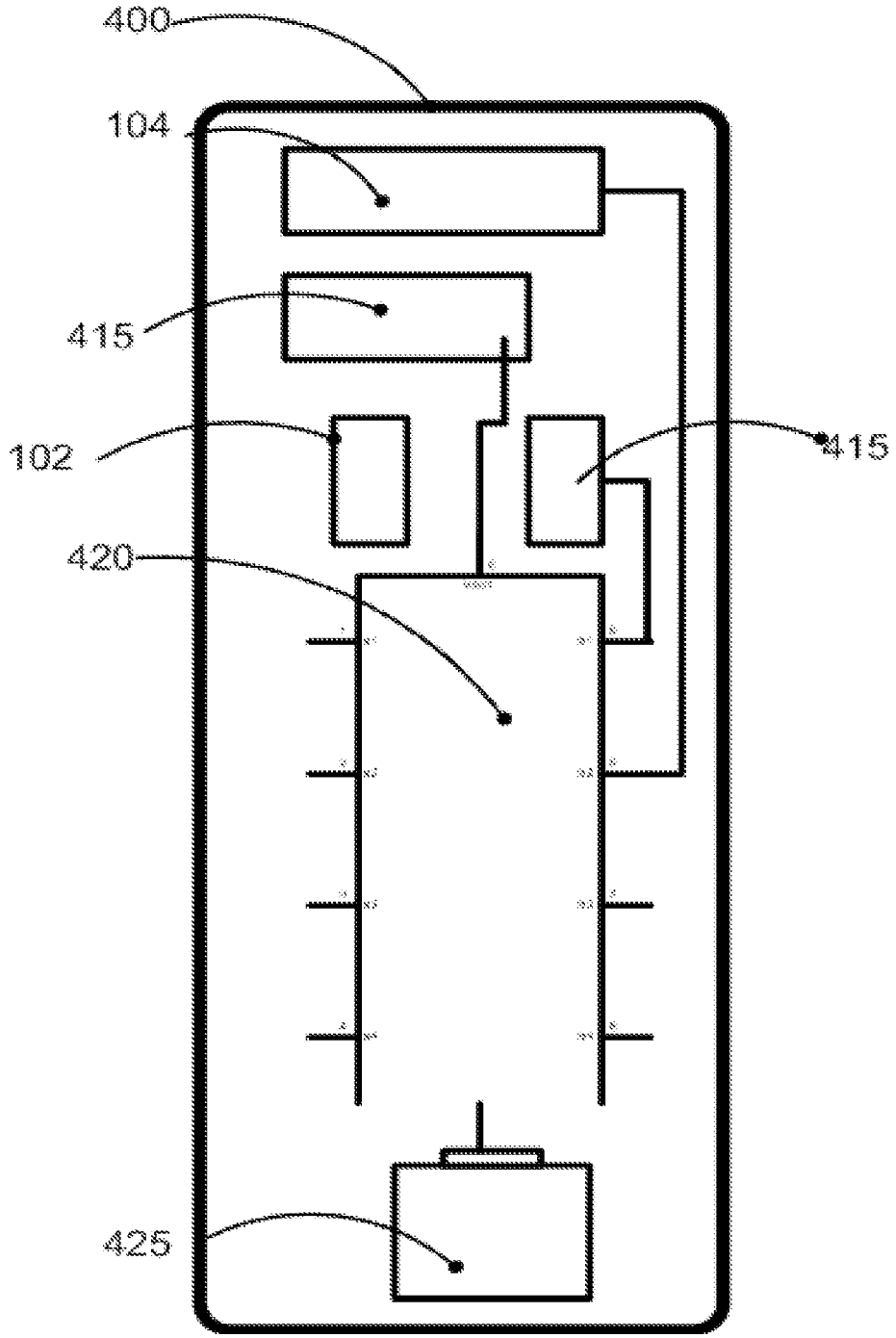
FIG. 4 illustrates the system hardware components of the firearm according to example embodiments.

FIG. 4 illustrates an example configuration of the sensors and communication components which may be integrated into the firearm. Referring to FIG. 4, the firearm component 400 may be one sticker, magnet, or other affixable and/or mountable block of sub-components described below. For instance, the sub-component may include an active RF ID tag 104, a passive RF ID tag 102, a GPS antenna 410, a BLUETOOTH antenna 415, a microcontroller chip 420 and a battery 425.

One example embodiment may include a holster with a weapon securing holster portion, such as flaps and a tunnel to place a barrel of a gun. The device may also include a wireless presence detection antenna which receives wireless proximity data from a weapon. The antenna may be an active or passive RFID or NFC tag that is in communication with a passive or active RFID or NFC tag affixed to the weapon. Also, at least one sensor may be affixed to the holster to detect a presence of the weapon via motion, movement, sound, etc.

The holster may include a processor configured to process sensor data generated by the at least one sensor, and process radio frequency signals identifying a proximity of the weapon to the wireless presence detection antenna. The processor is further configured to process geo-location data responsive to the weapon being removed from the weapon securing holster. The at least one sensor could a noise detection sensor which detects when the weapon has fired a shot and transmits a signal to the processor accordingly. Responsive to any of the activities associated with the weapon's movement, the geo-location data is acquired as global positioning system (GPS) data from an external mobile device. The processor is further configured to generate a message responsive to the weapon being removed from the weapon securing holster as detected by the wireless presence detection antenna. The processor is further configured to generate a message responsive to the weapon being fired as detected by the noise detection sensor which detects when the weapon has fired a shot. The processor further comprises an accelerometer and the processor is further configured to generate a message responsive to abnormal accelerometer data being received. Also, the wireless presence detection antenna receives wireless proximity data from a wireless tag affixed to the weapon. The wireless proximity data is received from the weapon when the weapon is moved out of the holster. The processor receives the wireless proximity data and generates an alert message to request additional police backup. Additionally, the processor receives a noise indicator from the at least one sensor and generates an alert message to request assistance for shots being fired. When the processor receives abnormal accelerometer data from the accelerometer, it generates an alert message to request assistance for officer being down.

An example method of operation may include receiving via a wireless presence detection antenna wireless proximity data from a weapon in wireless communication with a weapon holster comprising the wireless presence detection antenna, detecting a sensor condition triggered via at least one sensor affixed to the weapon holster, and creating a message to request assistance responsive to at least one of the wireless proximity data being received and the sensor condition being triggered.

The method may also include processing via a processor sensor data generated by the at least one sensor, processing radio frequency signals identifying a proximity of the weapon to the wireless presence detection antenna, processing geo-location data responsive to the weapon being removed from the weapon securing holster. The at least one sensor could be a noise detection sensor which detects when the weapon has fired a shot and transmits a signal to the processor. The geo-location data is acquired as global positioning system (GPS) data from an external mobile device. The method may include generating a message responsive to the weapon being removed from the weapon securing holster as detected by the wireless presence detection antenna, and generating a message responsive to the weapon being fired as detected by the noise detection sensor which detects when the weapon has fired a shot.

It will be readily understood that the components of the application, as generally described and illustrated in the figures herein, may be arranged and designed in a wide variety of different configurations. Thus, the detailed description of the embodiments is not intended to limit the scope of the application as claimed, but is merely representative of selected embodiments of the application.

Therefore, although the application has been described based upon these preferred embodiments, it would be apparent to those of skill in the art that certain modifications, variations, and alternative constructions would be apparent, while remaining within the spirit and scope of the application. In order to determine the metes and bounds of the application, therefore, reference should be made to the appended claims.

What is claimed is:

1. An apparatus comprising:

a weapon securing holster;

a wireless presence detection antenna which receives wireless proximity data from a weapon; and at least one sensor which detects a presence of the weapon, wherein the at least one senor comprises an active radio frequency identification (RFID) tag, which detects a presence of a passive REID tag on the weapon, and wherein the detected presence of the weapon comprises a determination that the weapon has been removed from the weapon securing holster.

2. The apparatus of claim 1, further comprising:

a processor configured to process sensor data generated by at least one sensor, and process radio frequency signals identifying a proximity of the weapon to the wireless presence detection antenna.

3. The apparatus of claim 2, wherein the processor is further configured to process geo-location data responsive to the weapon being removed from the weapon securing holster.

4. The apparatus of claim 2, wherein the at least one sensor further comprises a noise detection sensor which detects when the weapon has fired a shot and transmits a single to the processor.

5. The apparatus of claim 3, wherein the geo-location data is acquired as global positioning system (GPS) data from an external mobile device.

6. The apparatus of claim 2, wherein the processor is further configured to generate a message responsive to the weapon being removed from the weapon securing holster as detected by the wireless presence detection antenna.

7. The apparatus of claim 4, wherein the processor is further configured to generate a message responsive to the weapon being fired as detected by the noise detection sensor which detects when the weapon has tired a shot.

8. The apparatus of claim 2, wherein the processor further comprises an accelerometer, and wherein the processor is further configured to generate a message responsive to abnormal accelerometer data being received.

9. The apparatus of claim 1, wherein the processor receives the wireless proximity data and generates an alert message to request additional police backup.

10. The apparatus of claim 1, wherein the processor receives a noise indicator from the at least one sensor and generates an alert message to request assistance for shots being fired.

11. The apparatus of claim 8, wherein the processor receives abnormal accelerometer data from the accelerometer and generates an alert message to request assistance for officer being down.

12. A method comprising:

receiving via a wireless presence detection antenna wireless proximity data from a weapon in wireless communication with a weapon holster comprising the wireless presence detection antenna and at least one sensor affixed to the weapon holster:

detecting a sensor condition triggered via the at least one sensor affixed to the weapon holster, wherein the at least one sensor affixed to the weapon holster comprises an active radio frequency identification (MD) tag, which detects a presence of the at least one sensor affixed to the weapon which comprises a passive RFID tag;

determining that the weapon has been removed from the weapon holster based on communication between the active RFD tag and the passive RFID tag; and creating a message to request assistance responsive to at least one of the wireless proximity data being received and the sensor condition being triggered.

13. The method of claim 12, further comprising:

processing via a processor sensor data generated by the at least one sensor; and process radio frequency signals identifying a proximity of the weapon to the wireless presence detection antenna.

14. The method of claim 13, further comprising:

processing geo-location data responsive to the weapon being removed from the weapon securing holster.

15. The method of claim 14, wherein the at least one sensor affixed to the weapon holster further comprises a noise detection sensor which detects when the weapon has fired a shot and transmits a signal to the processor.

16. The method of claim 15, wherein the geo-location data is acquired as global positioning system (GPS) data from an external mobile device.

17. The method of claim 15, further comprising:

generating a message responsive to the weapon being removed from the weapon securing holster as detected by the wireless presence detection antenna.

18. The method of claim 17, further comprising:

generating a message responsive to the weapon being fired as detected by the noise detection sensor which detects when the weapon has fired a shot.

* * * * *